US011933208B2

(12) United States Patent
Fabiani

(10) Patent No.: US 11,933,208 B2
(45) Date of Patent: Mar. 19, 2024

(54) AFTER-MARKET REPLACEMENT KIT TO TEMPORARILY BYPASS A VEHICLE'S MUFFLER SILENCER RESONATORS TO IMPROVE EXHAUST SOUND, PERFORMANCE, FUEL ECONOMY AND OTHER CHARACTERISTICS

(71) Applicant: Fabspeed.com, Inc., Fort Washington, PA (US)

(72) Inventor: Joseph Fabiani, Fort Washington, PA (US)

(73) Assignee: Fabspeed.com, Inc., Fort Washington, PA (US)

( * ) Notice: Subject to any disclaimer, the term of this patent is extended or adjusted under 35 U.S.C. 154(b) by 354 days.

(21) Appl. No.: 17/308,727

(22) Filed: May 5, 2021

(65) Prior Publication Data

US 2022/0356823 A1 Nov. 10, 2022

(51) Int. Cl.
*F01N 13/18* (2010.01)

(52) U.S. Cl.
CPC ..... *F01N 13/1805* (2013.01); *F01N 2240/36* (2013.01); *F01N 2410/10* (2013.01)

(58) Field of Classification Search
CPC ..... F01N 13/1805; F01N 13/1838; F01N 13/1844; F01N 2410/10
See application file for complete search history.

(56) References Cited

U.S. PATENT DOCUMENTS

| | | | |
|---|---|---|---|
| 5,775,100 | A | 7/1998 | Sloss et al. |
| 2011/0023452 | A1 | 2/2011 | Gisslen et al. |
| 2021/0404369 | A1 | 12/2021 | Fabiani |

FOREIGN PATENT DOCUMENTS

| | | | | |
|---|---|---|---|---|
| EP | 0433735 B1 | | 8/1994 | |
| GB | 2252129 A | * | 7/1992 | ..... F01N 1/006 |

OTHER PUBLICATIONS

Screen captures from YouTube video clip entitled "How To Replace A Catalytic Converter—Chrysler Town & Country 3.8L," 5 pages, uploaded Aug. 8, 2013 by user "Autoeclinic". Retrieved from internet: <https://www.youtube.com/watch?v=tUqph3HQZm0>. (Year: 2023).*

Screen captures from YouTube video clip entitled "Here's What a Muffler Delete Sounds Like on a Porsche GT3-991 Muffler Delete DIY," 4 pages, uploaded Oct. 30, 2020 by user "EatSleepDrive". Retrieved from internet: <https://www.youtube.com/watch?v=FI--ZW7Aioo>. (Year: 2023).*

(Continued)

*Primary Examiner* — Jonathan R Matthias
(74) *Attorney, Agent, or Firm* — Design IP

(57) ABSTRACT

A replacement kit enables a user to generate a desired audible sound from an exhaust system of a motor vehicle. The kit includes a replacement catalytic converter arranged to replace the vehicle's original equipment catalytic converter. The replacement catalytic converter is connected to the vehicle's factory muffler through a replacement pipe segment to obtain a more desirable, yet muffled engine sound. The factory muffler may be removed from the motor vehicle and the replacement catalytic converter may instead be connected to a muffler bypass pipe or pipes or replacement exhaust components/segments which channels the exhaust flow directly to the atmosphere to obtain a more powerful unmuffled exciting visceral sports car engine sound.

12 Claims, 5 Drawing Sheets

(56) References Cited

OTHER PUBLICATIONS

Screen captures from YouTube video clip entitled "Install a Magnaflow Catalytic Converter, Universal Fit," 5 pages, uploaded Feb. 18, 2013 by user "Things on Video". Retrieved from internet: <https://www.youtube.com/watch?v=Fa3Bjx-4wac0>. (Year: 2023).*
European Patent Office, International Search Report, dated Aug. 3, 2022, for International Application No. PCT/US2022/027430.

* cited by examiner

AFTER-MARKET REPLACEMENT KIT TO TEMPORARILY BYPASS A VEHICLE'S MUFFLER SILENCER RESONATORS TO IMPROVE EXHAUST SOUND, PERFORMANCE, FUEL ECONOMY AND OTHER CHARACTERISTICS

FIELD OF INVENTION

The invention generally relates to automobile exhaust systems and, more particularly, the invention relates to controlling the sound of automobile exhaust systems.

BACKGROUND

Automobiles have exhaust systems to guide exhaust gases away from the controlled combustion taking place inside their engines. In addition to exhausting gases, automobile exhaust systems also control and attenuate engine noise. Specifically, much of the engine noise produced by the internal combustion process emanates through the exhaust system. In fact, that noise can be quite loud and, consequently, disturbing to the driver and people near the driver if there is no exhaust muffler. Exhaust systems therefore typically have multiple mufflers and resonators in the exhaust system to reduce that engine noise. The mufflers often are configured to mitigate the noise to levels defined by state and local noise regulations and or by design by the original automotive manufacturer to have whisper quiet transportation if that is the sound level to be achieved.

Sports car, SUV, and sport truck enthusiasts, however, may prefer to hear the full sound of their engines. For example, sports car enthusiasts often prefer to hear the "rumble and throaty gutsy sound" of their engines when driving their sports cars on public roads, to car shows, rallies and or on a closed track. Indeed, the muffler function often is not legally necessary on a track in this instance since tracks generally are not subject to the municipal noise regulations. Some tracks, however, are subject to noise regulations and thus, also still must be muffled to some extent to comply with the noise regulations. The majority of cars, SUVs, Sport Trucks have virtually no sound and often are simply ultra-quiet transportation appliances almost as quiet as electric cars.

Many car models including sports cars, produce a distinctive engine sound that convey a sense of power and passion waiting to be unleashed. Today, however, emphasis is placed on producing fuel efficient, quieter cars that make very little engine noise. Many motorists, however, especially car aficionados, regardless of what kind of car they buy, want a car that communicates a distinguishing sound of controlled power, like a finely-tuned instrument. Obviously, it would be advantageous to provide a means for allowing motorists to select an exhaust sound that produces a quiet, muffled sound or a distinctive and powerful sound.

SUMMARY

A replacement kit enables a user to generate a desired audible sound from an exhaust system of a motor vehicle. The kit includes a replacement catalytic converter arranged to replace the vehicle's original equipment catalytic converter. The replacement catalytic converter is connected to the vehicle's factory muffler through a replacement pipe segment to obtain a more desirable, yet muffled engine sound. The factory muffler may be removed from the motor vehicle and the replacement catalytic converter may instead be connected to a muffler bypass pipe or pipes or replacement exhaust components/segments which channels the exhaust flow directly to the atmosphere to obtain a more powerful unmuffled exciting visceral sports car engine sound.

BRIEF DESCRIPTION OF THE DRAWING(S)

The invention will be described in conjunction with the following drawings in which like reference numerals designate like elements and wherein.

Figure 1:
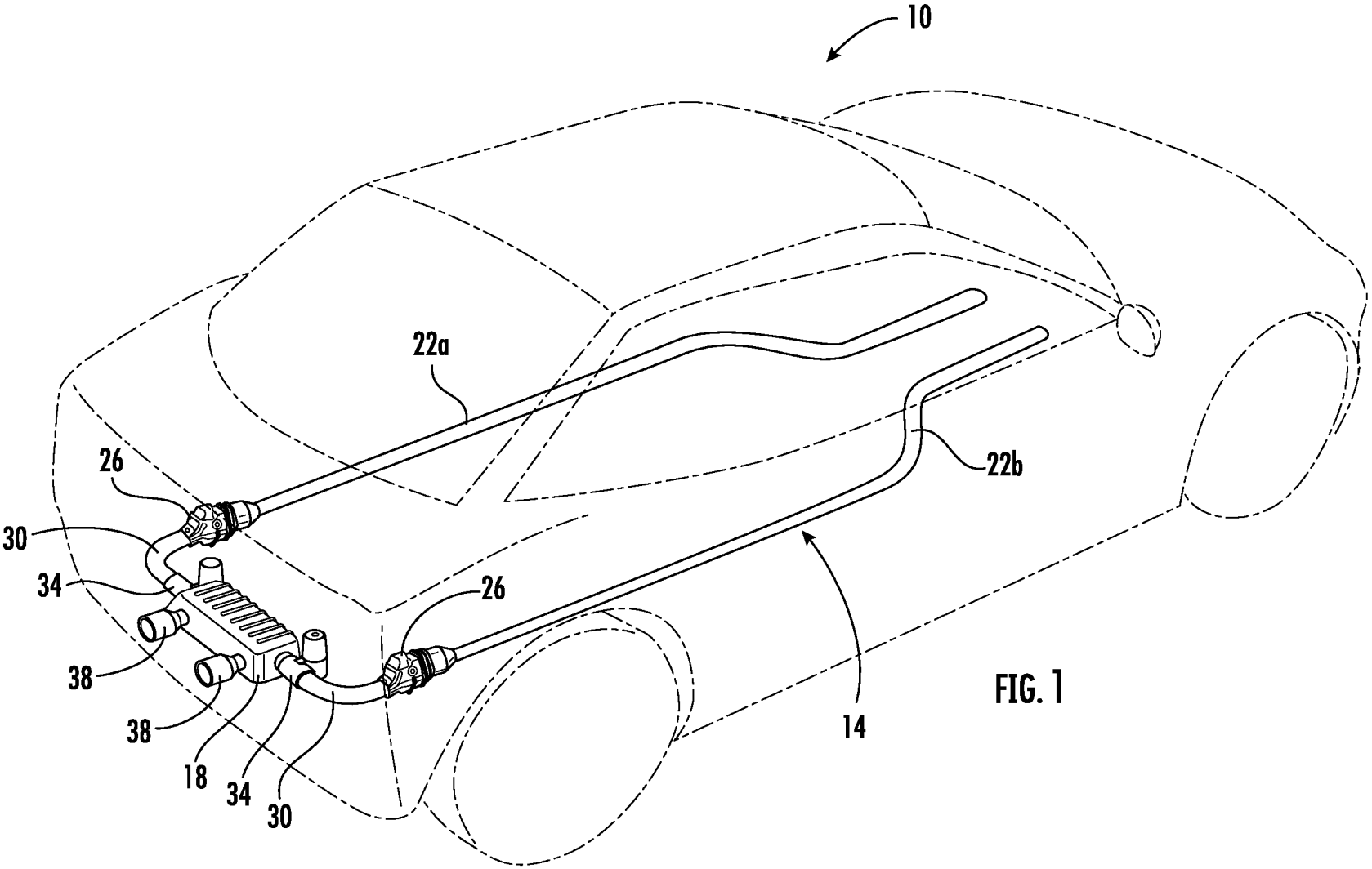
FIG. 1 is a perspective view of a factory provided exhaust system situated within a motor vehicle, the factory provided exhaust system including exhaust pipe segments, factory provided catalytic converters, and a factory provided muffler.
Figure 3:
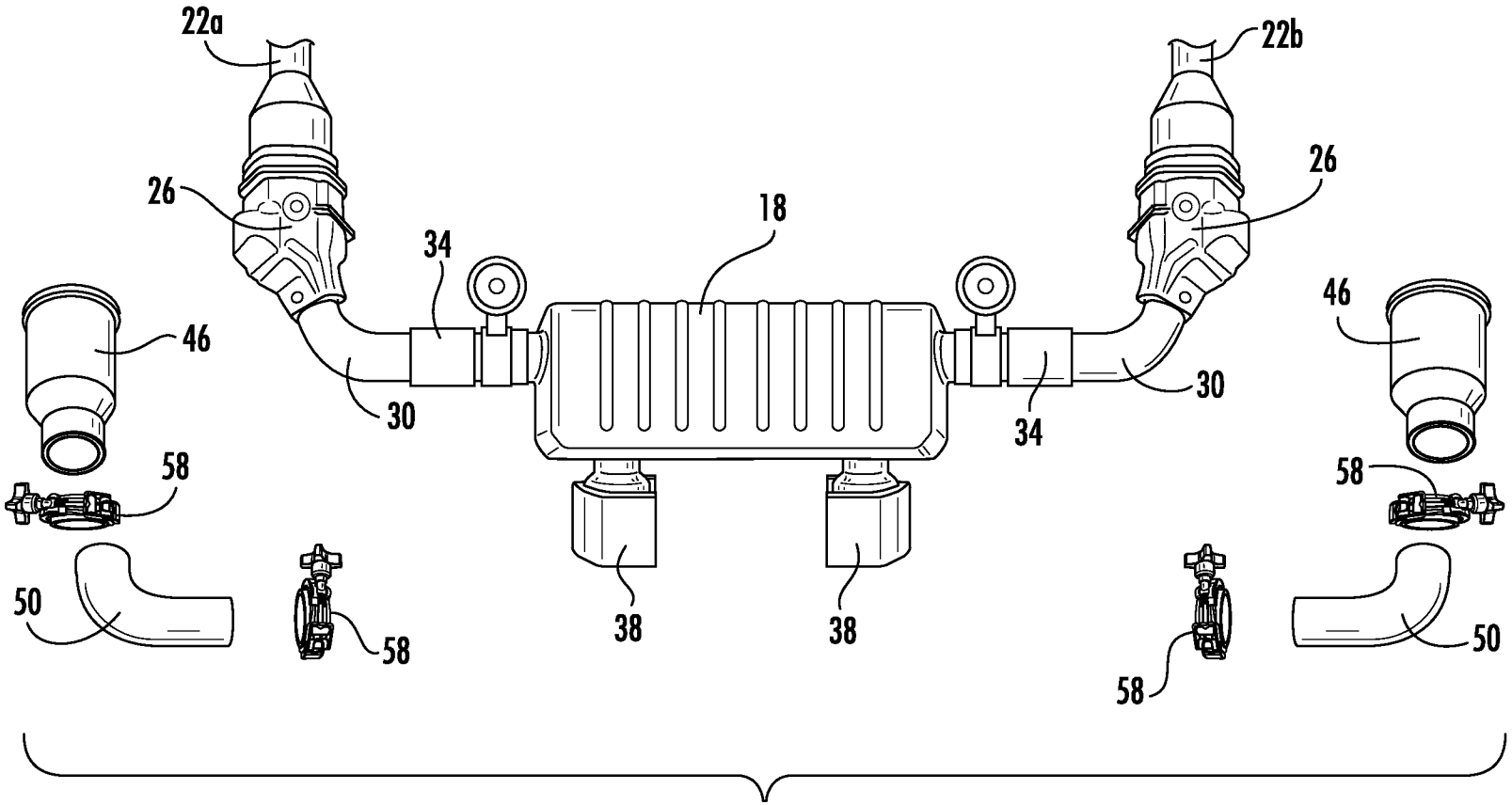
Figure 4:
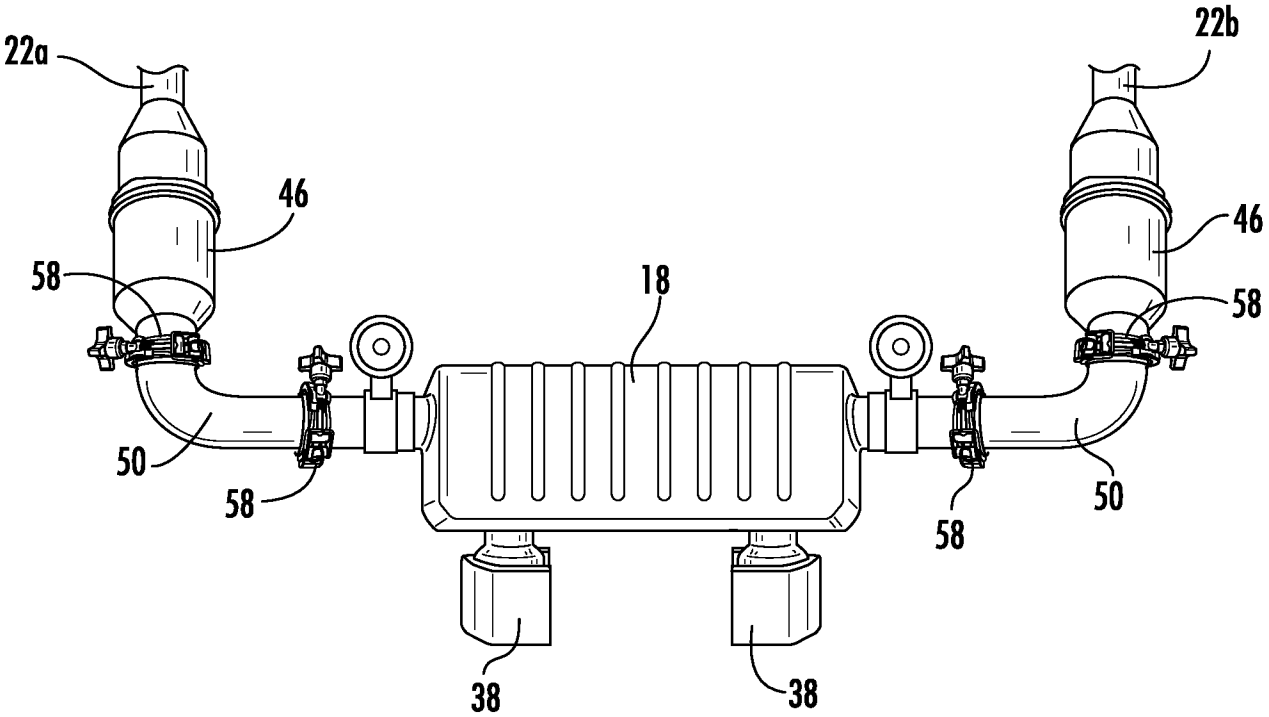
Figure 5:
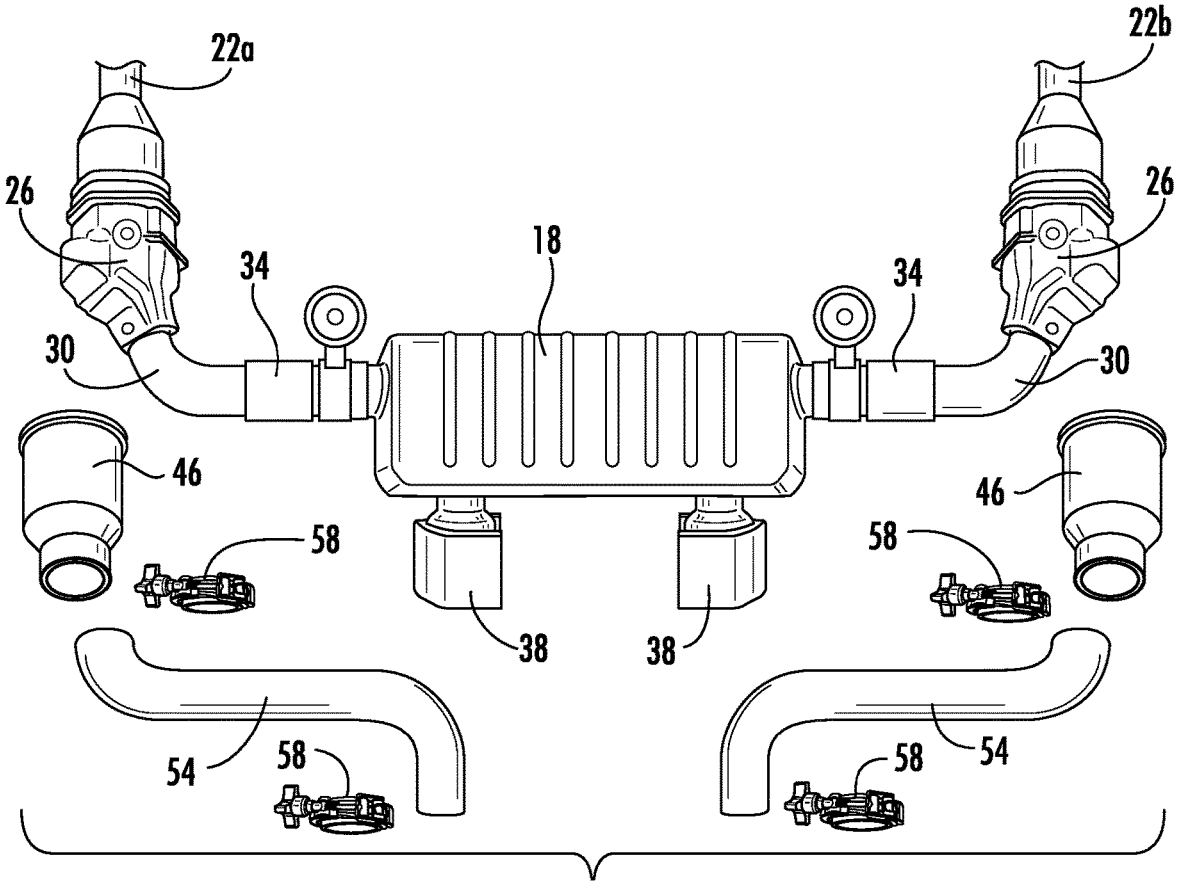
Figure 6:
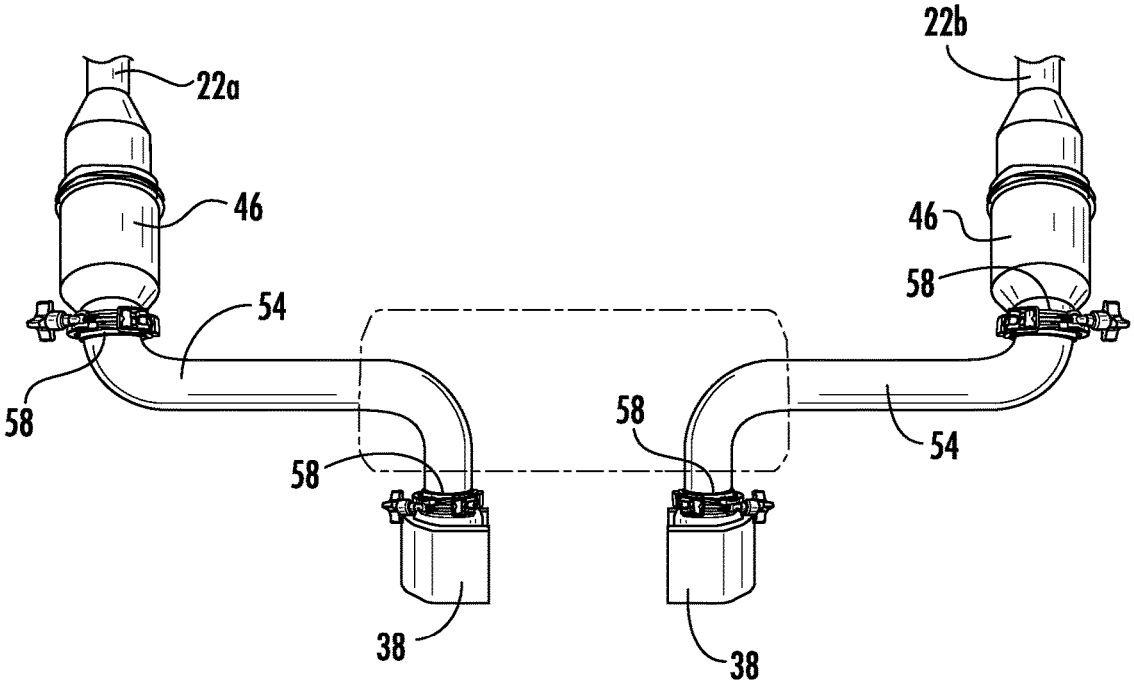

FIG. 3 is a perspective view of a portion of the original equipment exhaust system of FIG. 1 including a factory-provided muffler and factory provided catalytic converter, along with kit-provided components including left and right replacement catalytic converters, left and right curved pipe segments, and openable securement clamps arranged for attaching the kit-provided components to the factory provided center muffler exhaust system;

FIG. 4 is a perspective view of the kit-provided components assembled to the factory provided muffler and other components of the factory provided center muffler exhaust system utilizing kit-provided openable securement clamps;

FIG. 5 is a perspective view of a portion of the factory provided exhaust system of FIG. 1, and also illustrating kit-provided replacement components, including a kit-provided replacement catalytic converter, and bypass pipe segments for bypassing and replacing the muffler or silcencer; and, FIG. 6 is an enlarged perspective view of the kit-provided components of the present invention assembled to the factory provided exhaust system utilizing kit-provided openable securement clamps to bypass the vehicle's factory-provided muffler, which is shown as having been removed from the exhaust system.

DETAILED DESCRIPTION OF THE PREFERRED EMBODIMENT(S)

Certain terminology is used in the following description for convenience only and is not limiting. The phrases "factory provided" and "original equipment" are intended to refer to parts assembled and installed during the construction of a new vehicle. The term "after-market" refers to replacement parts for the enhancement of the original vehicle after its sale to the user.

Referring to FIG. 1, there is shown a vehicle 10 including a factory provided exhaust system 14 including a factory provided muffler 18. The muffler 18 is configured for use with an internal combustion engine (not shown) which may be situated at the front of the vehicle 10 as shown in FIG. 1, or could be situated at any other location of the vehicle including the rear or middle portion of the vehicle 10. In particular, the internal combustion engine may be a high-performance engine normally used in sports cars. A sports car enthusiast typically desires a deep, throaty "sports car" exhaust sound to emanate from the car. Moreover, it is desirable that this throaty sports car sound be accompanied by enhanced performance of the engine.

Although the original equipment muffler 18 is described as being used with an internal combustion engine of a vehicle 10, such as a sports car, it should be understood that the muffler 18 may be adapted for use with a variety of vehicles, such as a conventional automobile, truck, van, motorcycle, speed boat, and the like. Moreover, the muffler 18 may be provided as original equipment on a new sports car.

Figure 2:
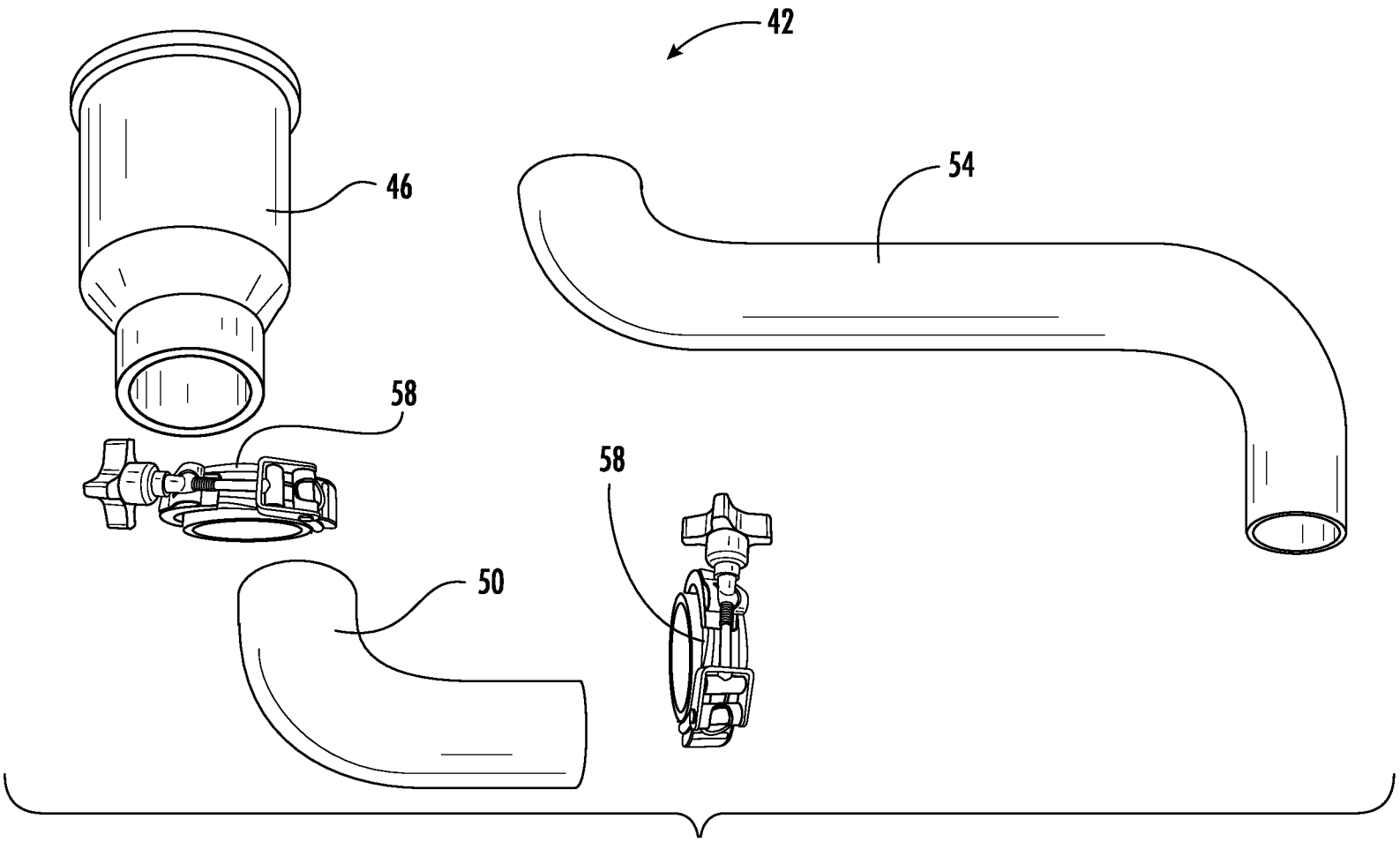
FIG. 2 is a perspective view of components of the kit of the present invention including a kit-provided replacement catalytic converter, kit-provided curved and bypass pipe segments, and openable securement clamps.

As best shown in FIGS. 1-3, elements of the factory provided exhaust system include exhaust pipes 22*a* and 22*b*, which branch from left and right sides of the engine (not shown) and extend to the rear from the front of the vehicle towards the rear of the vehicle 10. The exhaust system 14 may include a factory provided catalytic converter 26 located within each exhaust flow path between the engine and a factory provided muffler 18. At its upstream end, the factory provided catalytic converter 26 may be attached to the exhaust pipes 22*a*, 22*b* by any suitable means, e.g., welding. At its downstream end, the catalytic converter 26 may be attached to factory provided curved pipe segments 30 by any suitable means, e.g., welding. The curved pipe segments 30 may be attached to the factory provided muffler 18 by any suitable means, e.g., a clamp 34 utilizing bolts. The exit end of the muffler 18 may be connected to factory provided tail pipes 38 for releasing exhaust gases to the atmosphere. It should be understood that the location of the tail pipes 38 illustrated in FIG. 1 is merely exemplary, and one or more tail pipes 38 could be positioned at other location at the rear of the vehicle 10.

During engine operation, air is drawn into the internal combustion engine and directed into the internal combustion engine cylinders. The air drawn into the cylinders mixes with fuel to enable the combustion process in the cylinders of the internal combustion engine in a conventional manner. The resulting product of this combustion process is exhaust gas, which is discharged from the cylinders. The exhaust gas flows from the combustion engine through the exhaust pipes 22*a* and 22*b* and enters the factory provided catalytic converters 26 where harmful components may be removed. The cleansed exhaust gases flow from the catalytic converters 26 through the curved pipes 30 (which may be welded to the catalytic converters 26) and into opposed ends of the muffler 18 which dissipates the loud sounds created by the engine's pistons and valves. Thereafter, the exhaust gases flow from the muffler to the tail pipes 38 where they are released to the atmosphere.

For example, the replacement kit 42 may include one or more of the following components:

a. replacement catalytic converters 46;

b. replacement curved pipe segments 50;

c. openable securement clamps 58; and, d. bypass pipes 54.

Referring now to FIG. 2-4, components of the replacement kit 42 are shown replacing components of the factory provided exhaust system 14. The components of the replacement kit 42 include one or more replacement catalytic converters 46, one or more replacement curved pipe segments 50, one or more bypass pipes 54, and one or more openable securement clamps 58. The replacement catalytic converters 46 may be higher performance catalytic converters than provided by the vehicle's manufacturer. Such higher performance catalytic converters 46 may enable better vehicle performance characteristics than the factory provided catalytic converters 26, and may also provide a more distinctive and powerful engine sound.

As best shown in FIG. 1, under a first configuration, parts of the replacement kit 42 may be installed to the factory provided exhaust system 14 to replace the factory installed catalytic converter 26 while keeping the factory installed muffler 18 in place. Specifically, the clamp 34 may be unbolted to enable detachment of the factory provided curved pipe segment 30 and factory provided catalytic converter 26 from the exhaust system 14. With the curved pipe segments 30 and catalytic converters 26 removed from the exhaust system 14, replacement parts including the replacement catalytic converter 46 and the curved pipe segments 50 may be installed. As best seen in FIGS. 3-4, the downstream end of the kit-provided curved pipe segment 50 may be secured to the factory provided muffler 18 utilizing a kit-provided openable securement clamp 58. Although FIG. 4 illustrates the use of the kit-provided openable securement clamp 58 to secure the curved pipe segment 50 to the factory provided muffler 18, as an alternative, the factory provided clamp 34 could be utilized for securing these components together. The kit-provided openable securement clamps 58 may be a quick-release v-band type securement clamp arranged for joining end-to-end components such as the curved pipe segment 50 to the factory provided muffler 18. For example, at the ends to be joined, the components (for example, the curved pipe segment 50 and factory provided muffler 18) may be provided with male and female v-band flanges. Alternatively, at the ends to be joined, the components may be provided with elements of a ball and socket joint. Alternatively, the openable securement clamp 58 could be a slip-joint type clamp. Other types of commonly known clamps could be utilized for the quick-release joining of the components discussed herein.

The downstream end of the replacement catalytic converter 46 may be secured to the upstream end of the curved pipe segment 50 utilizing a kit-provided openable securement clamp 58. As mentioned above, under the first configuration, the factory provided muffler 18 remains installed within the exhaust system 14, and the high-performance replacement catalytic converter 46 is installed to replace the factory provided catalytic converter 26 to provide the user with a more distinctive and powerful sound, yet enables the user to continue utilizing the factory provided muffler 18.

Referring now to FIGS. 1, 5 and 6, under a second configuration, in the event the user wants to obtain an even more powerful engine sound, the user may utilize the kit 42 to bypass the factory-provided muffler 18 entirely, and replace the factory-provided catalytic converters 26. Specifically, under this configuration, the user may detach and remove from the exhaust system 14 the factory provided muffler 18, the factory provided catalytic converters 26, and the curved connecting pipes 30 extending therebetween. The removed components may be set aside and replaced with components from the replacement kit 42 including the replacement catalytic converters 46, and bypass pipes 54, thus bypassing the factory provided muffler 18 which has been removed and directing the flow path of exhaust fumes directly to the atmosphere to obtain a more powerful unmuffled engine sound. The bypass pipes 54 may be an s-shape or shaped in any other configuration to enable locating their exit end at the location where the tail pipes 38 of the muffler 18 were located prior to removal of the muffler. The bypass pipes 54 may be shaped in other configurations to have their exit ends located at other positions along the rear of the vehicle 10. At its upstream end, each catalytic converter 46 may be connected to the downstream end of the exhaust pipes 22*a* and 22*b*. At its upstream end, each bypass pipe 54 may be connected to the replacement catalytic converter 46 utilizing an openable securement clamp 58. At the downstream end, the bypass pipe 54 may include a free end that directs exhaust flow directly to the atmosphere, or as shown in FIG. 6 may be connected and secured to the tail pipe 38 by any suitable means, such as by utilizing an openable securement clamp 58 of the kit 42. With the muffler 18 removed and bypassed, its muffling effect on the engine sound is removed, to eliminate weight and provide a more powerful engine sound, visceral passionate sports car sound and better fuel economy.

If at some point the user decides to re-install the factory provided muffler 18, the bypass pipes 54 may be readily and quickly detached from the replacement catalytic converters 46 simply by opening the openable securement clamps 58. The factory provided muffler 18 may then be reinstalled to the vehicle and connected to the replacement catalytic converter 46 utilizing the kit-provided curved pipe segments 50 and utilizing the kit-provided openable securement clamps 58 at the upstream and downstream ends of the curved pipe segments 50. Also, the muffler 18 may be reconnected to the tail pipes 38 utilizing the kit-provided openable securement clamps 58, or by any other suitable securement mechanisms.

While a specific embodiment of the invention has been shown and described in detail to illustrate the application of the inventive principles, it will be understood that the invention may be embodied otherwise without departing from such principles.

What is claimed is:

1. A replacement kit to enable a user to generate a desired audible sound levels from an engine of a motor vehicle, the motor vehicle provided with a factory catalytic converter positioned within an exhaust flow path between the engine and a factory muffler, the factory catalytic converter connected to the factory muffler through a factory pipe segment, the factory muffler having a downstream end fitted to a pipe section visible to the motor vehicle's exterior, the factory catalytic converter and factory pipe segment having been detached and removed from the motor vehicle for replacement, the replacement kit comprising:

a. a replacement catalytic converter and a replacement pipe segment arranged for positioning within the exhaust flow path between the engine and the factory muffler to replace the detached and removed factory catalytic converter and factory pipe segment, the replacement catalytic converter having higher performance characteristics than the factory catalytic converter and having an upstream end for receiving exhaust gases from the engine and a downstream end;

b. the replacement pipe segment having an upstream end detachably connected to the downstream end of the replacement catalytic converter, and a downstream end detachably connected to an upstream end of the factory muffler to direct the exhaust flow path through the factory muffler; and c. a bypass pipe segment including an upstream end arranged for attachment to the downstream end of either the factory catalytic converter or the replacement catalytic converter, and an exit end arranged for fitting to the pipe section visible to the motor vehicle's exterior when the factory muffler has been detached and removed from the motor vehicle.

2. The replacement kit of claim 1, additionally comprising a first removable clamp arranged for tightening to connect the replacement catalytic converter to the replacement pipe segment to form a gas-tight seal therebetween, and a second removable clamp connecting the downstream end of the replacement pipe segment to the upstream end of the factory muffler for directing the exhaust flow path through the factory muffler; and, d. after step b and alternatively to step c, the method further comprises removing the factory muffler, positioning a bypass pipe segment within the exhaust flow path between the replacement catalytic converter and the pipe section visible to the vehicle's exterior, connecting an upstream end of the bypass pipe segment to the downstream end of the replacement catalytic converter, and fitting the downstream end of the bypass pipe segment to the pipe section visible to the motor vehicle's exterior.

3. The replacement kit of claim 2, wherein the replacement catalytic converter connects to the bypass pipe segment utilizing either one of the first removable clamp or the second removable clamps to provide a gas-tight seal between the bypass pipe segment and the replacement catalytic converter.

4. The replacement kit of claim 2, wherein the first and second removable clamps are quick-release v-band clamps.

5. The replacement kit of claim 1, wherein the replacement pipe segment has a curved configuration.

6. The replacement kit of claim 1, wherein the bypass pipe segment includes a curved configuration.

7. The replacement kit of claim 1, wherein the bypass pipe segment includes a substantially straight pipe.

8. The replacement kit of claim 1, wherein the pipe section visible to the motor vehicle's exterior is a factory tail pipe.

9. The replacement kit of claim 1, wherein the pipe section visible to the motor vehicle's exterior is an exhaust tip.

10. A method for modifying an exhaust system of a motor vehicle having an engine, an exhaust flow path, and a factory catalytic converter positioned within the exhaust flow path between the engine and a factory muffler having a downstream end attached to a pipe section visible to the motor vehicle's exterior, the factory catalytic converter being connected to the factory muffler through a factory pipe segment, the method comprising the steps of:

a. detaching and removing from the motor vehicle the factory catalytic converter and the factory pipe segment;

b. positioning a replacement catalytic converter within the exhaust flow path between the engine and the factory muffler;

c. positioning a replacement pipe segment within the exhaust flow path between the replacement catalytic converter and the factory muffler, connecting the upstream end of the replacement pipe segment to the downstream end of the replacement catalytic converter and arranged for tightening to connect the replacement pipe segment to the factory muffler to form a gas-tight seal therebetween.

11. The method of claim 10, wherein the pipe section visible to the motor vehicle's exterior is a factory tail pipe.

12. The method of claim 10, wherein the pipe section visible to the motor vehicle's exterior is an exhaust tip.

* * * * *